United States Patent [19]

Verbauwhede et al.

[11] Patent Number: 4,887,656

[45] Date of Patent: Dec. 19, 1989

[54] WOVEN FABRIC WITH BIAS WEFT AND TIRE REINFORCED BY SAME

[76] Inventors: Germain Verbauwhede, Kanaalstraat 84; Roger Vanassche, Paul Ferrardstraat 8d, both of B- 8550 Zwevegem, Belgium

[21] Appl. No.: 60,073

[22] Filed: Jun. 9, 1987

[30] Foreign Application Priority Data

Jun. 20, 1986 [GB] United Kingdom ..... 8615118
Jul. 24, 1986 [BE] Belgium ..... 1/011522

[51] Int. Cl.[4] ..... B60C 09/18; D03D 47/00

[52] U.S. Cl. ..... 152/531; 139/454; 139/DIG. 1; 152/563; 428/295

[58] Field of Search ..... 152/526, 527, 534, 563, 152/559, 535, 531; 428/295; 139/454, DIG. 1

[56] References Cited

U.S. PATENT DOCUMENTS

| | | | |
|---|---|---|---|
| 534,344 | 2/1895 | Morris | 139/454 |
| 1,201,257 | 10/1916 | Cobb | 152/563 X |
| 3,712,361 | 1/1973 | Streeter, Jr. | 152/563 X |
| 3,897,289 | 7/1975 | Di Paola | 156/124 X |
| 4,055,697 | 10/1977 | Schmanski | 26/97 X |
| 4,196,763 | 4/1980 | Imamura | 152/527 X |
| 4,305,433 | 12/1981 | Vanassche | 139/425 A |

FOREIGN PATENT DOCUMENTS

| | | | |
|---|---|---|---|
| 0293466 | 6/1914 | Fed. Rep. of Germany . | |
| 1272753 | 10/1960 | Fed. Rep. of Germany | 152/531 |
| 0351313 | 5/1905 | France | 152/563 |
| 48-30032 | 9/1973 | Japan | 139/454 |
| 0002533 | of 1912 | United Kingdom | 152/563 |
| 2102035 | 1/1983 | United Kingdom | 139/454 |

*Primary Examiner*—Raymond Hoch
*Attorney, Agent, or Firm*—Cushman, Darby & Cushman

[57] ABSTRACT

A bias weave fabric wherein the weft elements (2) have a tensile modulus of at least 30,000 N/mm$^2$ and the angle $\alpha$ between warp (3, 4) and weft (9) is between 10° and 85° whereas the packing factor (b/c) is between 30% and 90%. A process and apparatus for transforming a regular weave fabric (11) to a bias weave fabric is also covered whereby the regular fabric is guided in a zig zag path between a set of rollers (**22*a*–22*b*) crosswisely arranged in a frame (20**).

14 Claims, 3 Drawing Sheets

WOVEN FABRIC WITH BIAS WEFT AND TIRE REINFORCED BY SAME

This invention relates to woven fabrics with bias weft elements i.e. in which warp and weft threads enclose an angle different from 90°, and in particular to such a fabric suitable for the reinforcement of elastomeric articles such as vehicle tires, conveyor belts, drive belts, hoses and tubes. The invention relates also to a process and apparatus for making said fabrics.

It is known to apply parallel reinforcement wires or cords in the tread area of vehicle tires, which wires enclose an angle different from 90° with the circumferential direction of the tire. This state of the art is shown schematically in FIG. 2. Up to now, these series of wires are embedded in rubber sheets and the sheets are subsequently transversely cut according to a bias angle $\alpha$ to form parallelogram shaped strips 5. These strips are then deposited transversely in the tread area 7 of the tire to be built with their lateral edges 6 against each other and so that the bias cut edges are aligned at both circumferential edges 8 of the tread area. This cutting and positioning operation of the parallelogram shaped strip is very labour intensive. Therefor it is herewith proposed to avoid said operations by providing and embedding a woven fabric in rubber wherein the reinforcing weft elements have the desired angle with the circumferential direction of the tire, which circumferential direction then coincides with the warp direction in the fabric.

Viewed from one broad aspect there is herein disclosed a woven fabric comprising warp elements with a warp pitch "a" and threadlike weft elements with a width "b" and a weft pitch "c" in which the weft elements have a tensile modulus of at least 30.000 N/mm$^2$ and are at an angle $\alpha$ of between 10° and 85° to the warp elements and wherein the packing factor b/c as hereinafter defined is situated between 30% and 90%.

By tensile, or elastic modulus, is meant the ratio of tension to deformation when a force is applied to a wire or cord.

By means of this arrangement, at least in its preferred forms, the warp elements bring and keep the bias weft elements in position. In most case $15° \leqq \alpha \leqq 30°$ will be met and in a number of preferred embodiments $\alpha$ will be between about 18° and 22°. The warp elements can be arranged in groups. These warp groups will mostly have only two warp elements running adjacent each other and never more than three.

Some embodiments of the present invention will now be described by way of example with reference to the accompanying drawings in which.

Figure 1:
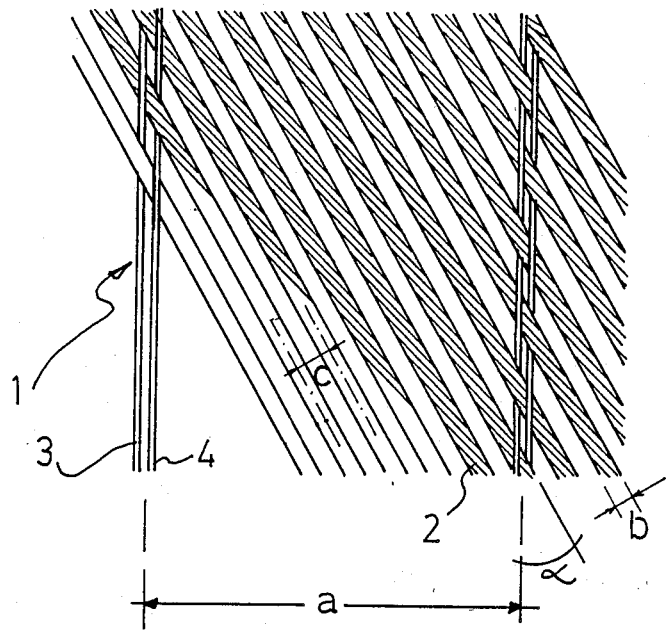
FIG. 1 shows a first embodiment of woven fabric having the warp elements arranged in pairs.
Figure 2:
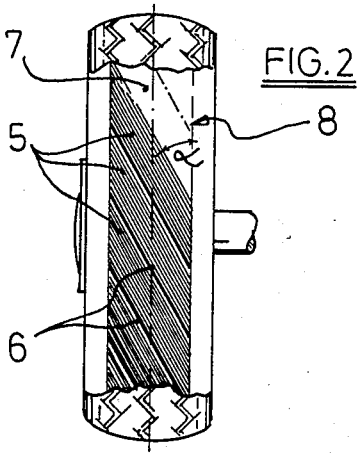

The woven fabric shown in FIG. 1 comprises a number of warp elements 1 arranged in pairs which fix the bias weft elements 2 in a woven pattern and forming an angle $\alpha$ between warp and weft. Each pair 1 comprises two thread like elements 3 and 4 which run alternatively over and under the weft elements 2 to be fixed. The distance "a" between subsequent warp elements groups (the warp pitch), particularly between warp pairs, is a multiple of the distance c between the axis of subsequent weft elements 2 (further designated as the weft pitch). In general, the relation $3\,c \leqq a \leqq 15\,c$ should be respected. For $15° \leqq \alpha \leqq 30°$ preferably $5\,c \leqq a \leqq 15\,c$ will apply.

The adjacent weft elements 2 are disposed quite close to each other so that the packing is between 30% and 90% and preferably between 45% and 80%. The packing is herewith defined as the ratio b/c in which b represents the width of the weft element measured in the neutral plane of the fabric. As a consequence of this close packing, the warp elements 3, 4 have to be very flexible and thinner than c−b. Hence, synthetic threads (e.g. monofilaments) or thin strands or yarns are preferred. Preferably, their thickness or diameter will even be lower than 0.75 (c−b).

When the woven fabric is destined for the reinforcement of elastomeric articles, the weft elements should have a substantial strength. By strength is intended here, besides increase of tensile and bending resistance, increase of stiffness, buckling resistance, axial compression resistance, impact resistance, torsion strength, fatigue resistance against cyclic loading etc. Weft elements 2 which are therefor applicable include threads, strands cords, laths or profiles comprising i.a. plastic resins (with optionally a longitudinal reinforcement therein), metal, carbon or glass. They will preferably have a tensile strength of at least 1000 N/mm$^2$. Weft elements from steel with a carbon content of between 0.65% and 1%, particularly steel wires or steel cords are very well suited. At least the weft elements 2 will have a surface layer which enhances adhesion to the elastomer compositions to be reinforced. For some reinforcing purposes it will be preferred that also the warp elements have a surface layer with a good adhesion capacity to elastomers.

Figure 3:
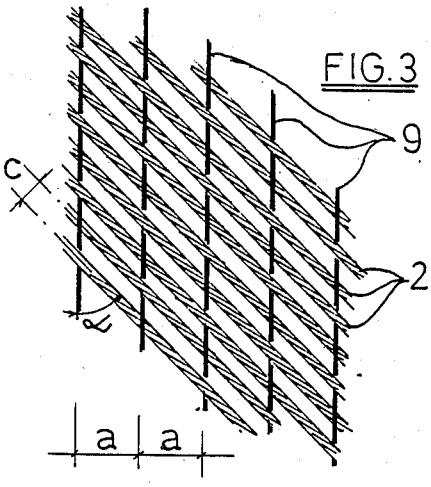
FIG. 3 illustrates a second embodiment in which the warp elements are not arranged in groups.

In case $\alpha$ has to be chosen very small, e.g. for $\alpha = 20°$, embodiments as shown in FIG. 3 may be preferred. The adjacent warp elements 9, which alternatively cross over and under the weft elements 2 (FIG. 3), are then not arranged in groups but run at mutual equal distances "a" from each other in a platt weave pattern. This distance (warp pitch) "a" will then preferably be chosen between 3c and 8c.

Figure 4:
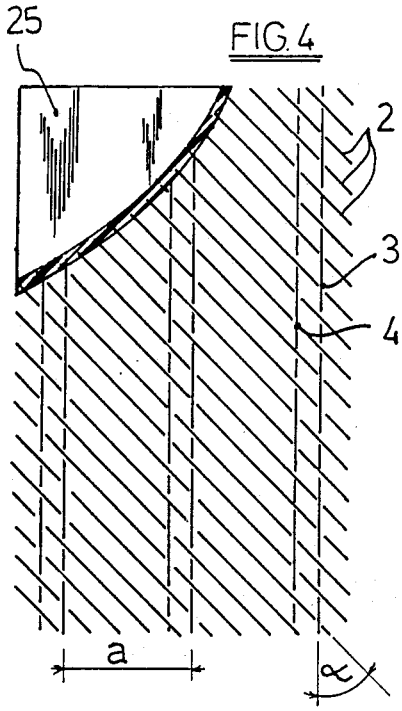
FIG. 4 shows another embodiment comprising another weave pattern between warp and weft.
Figure 9:
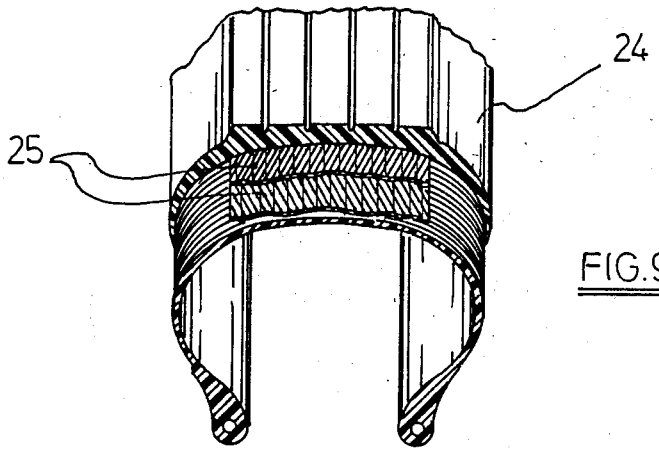
FIG. 9 is a perspective view of a vehicle tire having a fabric according to the embodiment embedded therein.

The woven fabric according to the invention will often be embedded in a rubber ply 25 with a thickness of less than about twice the thickness of the fabric (FIG. 4). The rubber ply 25 thus reinforced is then generally usable as an intermediate article for reinforcement of e.g. the tread portion of a vehicle tire. Such a vehicle tire section 24 is illustrated in FIG. 9 showing two superimposed plies 25 located in the tread portion thereof and wherein the warp elements run according to the circumferential direction of the tire.

Figure 5:
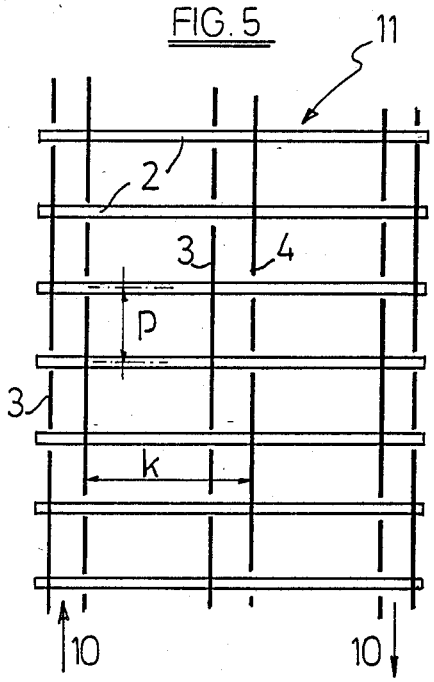
FIG. 5 represents the initial position of a fabric according to FIG. 4 before a bias deformation is applied.

The weave pattern between warp and weft can also be changed as desired with respect to the simple platt weave as shown in FIGS. 1 and 3. The warp pairs 3, 4 can be arranged according to the twill weave principle. An example of a twill weave is shown in FIGS. 4 and 5. The weave pattern shown presumably improves an easy fabric deformation during the bias drawing operation as suggested with arrows 10 in FIG. 5. Anyway, a relatively elevated bending stiffness (bending modulus) for the weft elements will facilitate an easy and even fabric deformation thereby keeping the weft elements straight and mutually parallel during deformation. The relation $3c \leqq a \leqq 8c$ is also applicable to a weaving pattern as shown in FIG. 4 or 5.

The invention relates also to a process for making the woven fabrics described above. The manufacture of said fabrics starts with the conventional and regular weaving of the warp and weft elements perpendicular to each other in platt weave or in a twill weave pattern as desired. The distances between subsequent warps (groups) and wefts is predetermined as a function of b, $\alpha$ and the required packing b/c for the weft elements. When the weft pitch in the regular fabric 11 is p, then the corresponding weft pitch $c=p \sin \alpha$ in the bias fabric. Similarly the warp pitch k in the regular fabric 11 will be reduced to a warp pitch $a=k \sin \alpha$ in the bias fabric.

Figure 6:
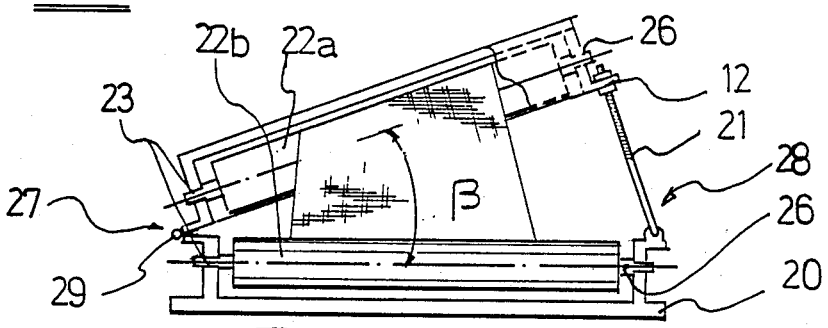
FIGS. 6, 7 and 8 are views of an apparatus for making a fabric with a bias weft.
Figure 7:
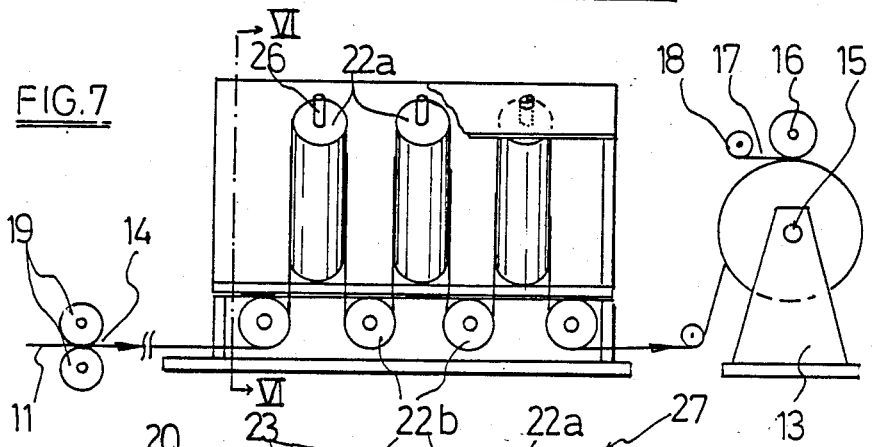
Figure 8:
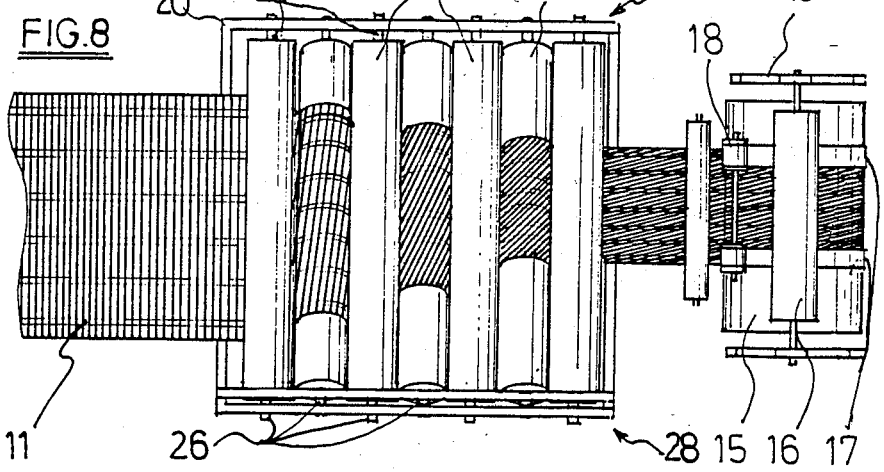

As shown in the examplary embodiment of FIGS. 6 to 8 the regular fabric 11 is then advanced to a set of rollers 22 *a*–22 *b*, e.g. by guiding it between a pair of cooperating rollers 19 whereby the weft can be translated parallel to the nip line 14 between these cooperating rollers. Downstream of said nip, the fabric is passed over and between consecutive revolvable rollers 22 *a*–22 *b* of the set, whereby each roller makes an angle with the preceding one and whereby the fabric follows a zig-zag path through this set of rollers. The rollers are arranged such that one longitudinal edge of the fabric (warp direction) is caused to run over a substantially shorter distance than the opposite longitudinal edge. The weft elements are thereby caused to displaced themselves progressively in an oblique (bias) direction with respect to the warp elements to ultimately form the desired angle $\alpha$ between warp and weft. The warp elements however, continue to run substantially parallel to the direction of advancement of the fabric and with the effect of a progressive decrease of the fabric width. Finally the fabric with the desired angle $\alpha$ different from 90° as delivered by the last roller of the set can be wound onto a beam 13 with the warp elements almost perpendicular to the rotating shaft 15 of the beam. A counterpressure roller 16, which runs parallel to the beam 13 will preferably cooperate with said beam to secure a proper and correct winding operation. It is to be noted, as further described in the example below, that the weft elements 2 will only displace themselves in an oblique direction upon the condition that the leading section of the fabric has been properly transformed by hand and that its leading edge has been fixed to the take-up device or beam with the weft forming the desired angle 90-$\alpha$ with the beam shaft direction.

An embodiment of an apparatus according to a further aspect of the invention will now be described with reference to FIGS. 6 and 8. Said apparatus for continuously transforming a fabric with a regular weave 11, having weft pitch $p=c/\sin \alpha$ and a warp pitch $k=a/\sin \alpha$ into a bias weave fabric with a weft pitch "c" and a warp pitch "a" is shown in the side view of FIG. 7. FIG. 8 is a top plane view of said apparatus whereas FIG. 6 is a cross sectional view of the set of rollers 22 *a*–22 *b* along line VI—VI in FIG. 7. The apparatus can comprise adjustable and controllable delivery means 19 for the regular fabric 11 which means may consist of a pair of cooperating delivery rollers. The apparatus essentially comprises a set of consecutive rollers 22 *a*–22 *b* crosswisely arranged in a frame 20 via their shaft extremities 23, 26 whereby each roller forms an angle $\beta$ with respect to the previous one to create a zig zag path for the fabric. The adjacent shaft extremities 23 at one lateral side 27 of the frame 20 are thereby disposed closer to each other than the shaft extremities 26 at the opposite lateral side 28.

The frame 28 20 may comprise two simple rectangular subframes which are mutually pivotably connected in 29 along the lateral side 27. In one of the subframes the consecutive rollers 22 *b* with uneven order number can be mounted in parallel. Consecutive rollers 22 a with an even order number can be fixed parallel in the other subframe. In this way the angle $\beta$ enclosed between each pair of consecutive rollers 22 *a*, 22 *b* is the same which is a convenient arrangement. This angle $\beta$ can be adjusted by means of e.g. a nut mounted onto a connecting rod 21 which links both subframes to each other at the lateral side 28.

The higher the number of rollers 22 *a*–22 *b*, the smaller will be angles $\beta$ to achieve a certain bias deformation angle $\alpha$. This will generally result in a smoothly progressing shift for the weft in the fabric from 90° to an angle $\alpha$ with the crossing warp elements. A frame 20 comprising a larger number of rollers, enclosing smaller angles $\beta$ with each other will generally permit a faster transportation speed of the fabric during the reshaping operation (or transformation) to a bias weave fabric. In this way weaving of regular fabrics with pitches p and k can be done in one place. These regular fabrics can be wound up and shipped to other places where the bias reshaping process can be performed at speeds which are generally much higher than the previous regular weaving operation.

The regular fabrics 11 which are thus transformed at a certain (higher) speed to bias weave fabrics can then also be delivered directly to a conventional calendering (and curing) station if desired to form a reinforced rubber ply 25. The provision of an intermediate take-up device 13 for storing the bias weave fabric can then be avoided. However if the bias woven fabric delivered by the reshaping apparatus has to be stored before further use then take-up means 13 have to be provided. These take-up means 13 can comprise a beam 15 which can be driven with an adjustable speed, e.g. through a counterpressure roller 16.

It can also be useful to dimensionally stabilise the bias weave fabric just before or together with the winding up operation. One or more stabilising strips 17 can then be concurrently wound in, which strips extend over at least a part of the fabric surface, e.g. next to its longitudinal edges. The stabilising strip 17 can be a substrate which is covered on one side with e.g. a rubberlike coating which is able to stick to the bias weave fabric, and releasable from both sides of the substrate 17. The so coated strip 17 can be delivered from a spool 18. Upon unwinding the bias weave fabric from the beam shaft 15 for further use (e.g. calendering) the substrates 17 (e.g. paperstrips) can be recovered and collected whereas the sticky coating remains on or in the fabric. Of course a coating will be chosen which is compatible with the matrix composition which has to be reinforced afterwards.

EXAMPLE

A regular fabric end 11 was woven with a width of 500 mm. In the warp direction pairs of nylon monofilaments 3, 4 were arranged in platt weave having each a diameter of 0.20 mm and in the weft steel strands with a structure 4×0.25 (i.e. four brass coated steel filaments with each a diameter of 0.25 mm twisted together ; cord diameter: about 0.65 mm ; lay length of the twist: 14 mm). The warp pitch k was about 20 mm and the weft pitch p was about 3.5 mm. The weft elements had a tensile modulus of about 180.000 N/mm$^2$.

The regular fabric was passed through an apparatus with a set of seven rollers 22 *a*–22 *b* as illustrated in FIGS. 6 to 8 to transform it to a bias weave fabric with an angle $\alpha$ of 24°30 and a width of 205 mm. The angle $\beta$ was thereby choosen at 16°. The transforming process was started by guiding the regular fabric by hand from the nip line 14 between the rollers 22 *a*–22 *b*, thereby forming a zig zag path while progressively forcing by hand the weft elements 2 in a bias position in such a way that the fabric front end, arriving at the take-up station 13 had been reshaped to a bias weave fabric with $\alpha$=24°30. The fabric width was thereby progressively reduced to about 205 mm. The bias leading end (parallel to the weft elements) was fixed on the beam shaft 15. Upon continuation of the weaving process of the regular fabric, the consecutive fabric sections delivered at the nip 14 by the driven roller pair 19 are now transported through the zig zag path and wound up on beam 15 which is driven by the counterpressure roller 16. The weft pitch "c" was about 1.5 mm and the warp pitch "a" amounted to about 8.3 mm. This means that a=5.53 c. The packing (b/c) of the weft elements 2 in the bias fabric amounted to 0.65/1.5=43.3%.

It is of course possible to produce bias weave fabric by a direct bias weaving process, using a loom where the weft elements are inserted obliquely between the warp elements. However, this method will generally require a more complex weaving loom and hence a larger investment.

Thus it will be seen that, at least in preferred forms, the reinforcement of an elastomeric article such as a vehicle tire is provided by embedding a woven fabric wherein the reinforcing weft elements having the desired angle with the circumferential direction of the tire, which direction then coincides with the warp direction in the fabric. The width of the embedded fabric strip is then adapted to the width of the tread while the fabric is cut to a length approximating the circumference length of the tire. The two outermost transverse edges of the fabric run according to the direction of the bias weft elements and touch each other after applying the strip around the tire carcass in the belt or tread area.

The woven fabrics, in which the bias weft elements have an elevated modulus, are suitable for use as a reinforcement for elastomeric articles such as vehicle tires, conveyor belts, drive belts, hoses and tubes.

We claim:

1. A woven fabric for reinforcing elastomers comprising warp elements with a warp pitch a and unidirectional single stranded threadlike weft elements with a width b, a tensile modulus of at least 180,000 N/mm$^2$ and a weft pitch c, characterized in that the angle $\alpha$ between warp and weft element is more than 15° and less than 30° whereas the packing factor b/c is between 45% and 80% and whereas $3c \leqq a \leqq 15c$.

2. A fabric according to claim 1, characterized in that $18° = \alpha \leqq 22°$.

3. A fabric according to claim 1, characterized in that the warp elements are arranged in groups.

4. A fabric according to claim 3, characterized in that said warp elements are arranged in pairs.

5. A fabric according to claim 1, characterized in that the warp elements run alternatively over and under subsequent weft elements.

6. A fabric according to claim 1, characterized in that the warp elements are arranged in a twill weave.

7. A fabric according to claim 1, characterized in that the weft elements have a tensile strength of at least 1000 N/mm$^2$.

8. A fabric according to claim 1, characterized in that the warp pitch is between about 3 and 8 times the weft pitch c.

9. A fabric according to claim 1, characterized in that the weft elements comprise steel with a carbon content of between 0.65% and 1%.

10. A fabric according to claim 1, characterized in that the weft elements are steel wires.

11. A fabric according to claim 1, characterized in that at least the weft elements have a surface layer which enhances adhesion to elastomers.

12. An elastomeric article reinforced with at least one fabric according to claim 11.

13. Rubber ply according to claim 12, having one fabric embedded therein, the ply thickness being less than twice the thickness of said fabric.

14. Vehicle tire according to claim 12, comprising at least one fabric in its tread area, wherein the warp elements run according to the circumferential direction of the tire.

* * * * *